US005975771A

United States Patent [19]

Ogiwara

[11] Patent Number: 5,975,771

[45] Date of Patent: Nov. 2, 1999

[54] DEVELOPMENT CONTROL METHOD DEVELOPING APPARATUS AND IMAGE EXPOSING APPARATUS

[75] Inventor: Nagao Ogiwara, Kanagawa, Japan

[73] Assignee: Fuji Photo Film Co., Ltd., Kanagawa, Japan

[21] Appl. No.: 08/857,673

[22] Filed: May 16, 1997

[30] Foreign Application Priority Data

May 17, 1996 [JP] Japan ..... 8-123552

[51] Int. Cl.[6] ..... G03D 13/00

[52] U.S. Cl. ..... 396/567; 396/570; 396/613

[58] Field of Search ..... 396/594, 595, 396/567, 568, 578, 612, 613, 570; 355/27–29

[56] References Cited

U.S. PATENT DOCUMENTS

| | | | |
|---|---|---|---|
| 4,864,332 | 9/1989 | Harvey | 396/319 |
| 5,493,355 | 2/1996 | Kazami | 396/319 |
| 5,543,882 | 8/1996 | Pagano et al. | 396/595 |
| 5,745,811 | 4/1998 | Okino et al. | 396/567 |

*Primary Examiner*—D. Rutledge

*Attorney, Agent, or Firm*—Sughrue, Mion, Zinn, Macpeak & Seas, PLLC

[57] ABSTRACT

A development control method capable of adequately determining exposed frames of a silver halide photosensitive material so as to develop the exposed frames. When a photographing operation is performed by using a predetermined negative film, exposure completion information indicating completion of exposure is recorded at a position corresponding to the position of each frame. When the negative film accommodated in a magazine is drawn out so as to be developed, reading of exposure completion information corresponding to the first frame is tried. If exposure completion information can be read, a determination can be performed that the frame has been exposed. Therefore, reading of exposure completion information corresponding to a next frame is tried. Reading of exposure completion information is sequentially tried for the following frames. When exposure completion information cannot be read, all of the exposed frames are determined to be detected. Thus, the negative film is cut at a boundary between the final exposed frame and a non-exposed region. Only the exposed frames are developed, while the non-exposed region is rewound into the magazine.

19 Claims, 13 Drawing Sheets

DEVELOPMENT CONTROL METHOD DEVELOPING APPARATUS AND IMAGE EXPOSING APPARATUS

BACKGROUND OF THE INVENTION

1. Field of the Invention

The present invention relates to a development control method, a developing apparatus and an image exposing apparatus, and more particularly to a development control method for controlling a process for developing an elongated silver halide photosensitive material on which exposed images each having a predetermined size have been formed, a developing apparatus adaptable to the development control method and an image exposing apparatus.

2. Description of the Related Art

Hitherto, films for use in cameras for taking pictures have been made of silver halide photosensitive materials. A latent image is formed in a photographed (exposed) portion of the silver halide photosensitive material. After the photographing operation has been performed, the silver halide photosensitive material is subjected to developing, fixing and water washing processes (a wet process) so that a readable image is formed.

However, the above-mentioned wet process to which one photographic film is subjected results in that the non-exposed portion of the film subjected to the wet process cannot be used. That is, the conventional development process using the wet process cannot be controlled such that only the exposed portion is developed and the non-exposed portion is not developed so as to be used later.

If only five frames of a photographic film having twenty four frames are used in a photographing operation, it is not possible to develop only the five frames. Therefore, development of the film has generally been performed after all of twenty four frames have been used. In an urgent case, the film is developed though all of twenty four frames are not used. Thus, nineteen residual frames are wasted in the above-mentioned case.

SUMMARY OF THE INVENTION

In view of the foregoing, an object of the present invention is to provide a development control method capable of adequately determining exposed frames of a silver halide photosensitive material to develop only the exposed frames, a developing apparatus and an image exposing apparatus required to execute the development control method.

In order to achieve the above-mentioned object, according to a first aspect of the present invention, there is provided a development control method comprising the steps of: previously recording exposure completion information indicating completion of exposure to positions corresponding to exposed image frames on an elongated silver halide photosensitive material wound up in a predetermined case when sequential exposure of images having a predetermined size is started at an end of the elongated silver halide photosensitive material. When the silver halide photosensitive material is drawn out from the case to develop the silver halide photosensitive material, exposure completion information items are sequentially read.

If exposure completion information can be read, a determination can be performed that exposed image frames exist. Therefore, exposure completion information items are sequentially read to determine exposed image frames of the silver halide photosensitive material in accordance with whether or not exposure completion information exist.

When exposure completion information cannot be read, a non-exposed region can be detected.

As described above, the final exposed image frame of the silver halide photosensitive material is determined. Then, the determined final image frame and the non-exposed region more rearward than the final image frame are separated from each other by cutting. The exposed region of the separated silver halide photosensitive material having the exposed image frames is developed, while the non-exposed region is rewound into the case.

As a result of the above-mentioned development control method enables exposed image frames of the silver halide photosensitive material to adequately be determined and thus only the exposed image frames to be developed. Since the non-exposed region is rewound into the case, it can be used when next image exposure is performed.

The development control method according to the first aspect of the present invention enables only the exposed image frames to be developed even in a state where all of the frames of the silver halide photosensitive material have not been exposed, that is, a portion of the frames has been exposed. Thus, the necessity to wait for completion of exposure of all of the frames of the silver halide photosensitive material can be eliminated.

According to a second aspect of the present invention, the development control method according to the first aspect has a structure: when the silver halide photosensitive material is developed, the number of frames in the non-exposed region able to be exposed is calculated in accordance with the number of all of frames of the silver halide photosensitive material able to be exposed and the number of exposed image frames obtained in accordance with the number of operations for reading exposure completion information. For example, the number of exposure completion information reading times is counted to obtain the number of exposed image frames. Then, the number of the exposed image frames is subtracted from the number of all of the frames of the silver halide photosensitive material able to be exposed so that the number of frames in the non-exposed region able to be exposed is obtained. Then, information indicating the obtained number of frames able to be exposed is recorded on the non-exposed region.

When the non-exposed region rewound into the case is afterwards drawn out from the case to expose images, information indicating the number of the frames able to be exposed is read to notify the number of the frames able to be exposed. As a result, an operator for exposing images by using the non-exposed region is able to recognize the number of frames able to be exposed.

According to a third aspect of the present invention, there is provided a developing apparatus for drawing out, from a predetermined case, an elongated silver halide photosensitive material, having exposed images to have a predetermined size and exposure completion information recorded at positions corresponding to the exposed frames and indicating completion of exposure, and wound up in the case, so as to develop the elongated silver halide photosensitive material, the developing apparatus comprising: cutting means for cutting the silver halide photosensitive material; exposure completion information reading means for sequentially reading exposure completion information from the drawn out silver halide photosensitive material; cutting control means for determining a final image frame of the silver halide photosensitive material on which exposure completion information has been recorded in accordance with a result of reading of exposure completion information performed by the exposure completion information reading means and controlling the cutting means to cut and separate the determined final image frame and a non-exposed region more rearward than the final image frame from each other; and rewinding means for rewinding the cut and separated non-exposed region into the case.

The developing apparatus according to a fourth aspect of the present invention has a structure according to the third aspect and further comprising calculating means for obtaining the number of frames in the non-exposed region able to be exposed in accordance with the number of all of frames of the silver halide photosensitive material able to be exposed and the number of exposed image frames obtained in accordance with the number of operations for reading exposure completion information; and means for recording information indicating the number of frames such that the means records, on the non-exposed region, information indicating the number of frames able to be exposed and which have been obtained by the calculating means.

With the developing apparatus according to the third aspect of the present invention, the silver halide photosensitive material having exposed images each having a predetermined size and exposure completion information indicating completion of exposure and recorded at positions corresponding to the exposed frames is drawn out from the case. Then, the exposure completion information reading means sequentially reads exposure completion information items from the drawn out silver halide photosensitive material.

If exposure completion information can be read, a determination can be performed that exposed image frames exist similarly to the first aspect of the present invention. Therefore, the exposure completion information items are sequentially read so that exposed image frames of the silver halide photosensitive material are determined in accordance with existence of exposure completion information. When exposure completion information cannot be read, start of non-exposed region can be determined.

As described above, the final exposed image frame of the silver halide photosensitive material is determined by the cutting control means to cut and separate the determined final image frame and the non-exposed region more rearward than the final image frame from each other. The exposed region of the cut and separated silver halide photosensitive material having the exposed image frames is developed, while the non-exposed region is rewound into the case.

Thus, the exposed image frames of the silver halide photosensitive material can adequately be determined and thus only the exposed image frames can be developed. Since the non-exposed region is rewound into the case, it can be used when a next image exposing operation is performed. Since only the exposed image frames can be developed even in a state where all of the frames of the silver halide photosensitive material have not been exposed, that is, a portion of the frames has been exposed, the necessity to wait for completion of exposure of all of the frames of the silver halide photosensitive material can be eliminated.

The developing apparatus according to the fourth aspect of the present invention has a structure according to the third aspect of the present invention and further comprising the calculating means and means for recording information indicating the number of frames. Thus, the calculating means obtains the number of frames in the non-exposed region able to be exposed in accordance with the number of all of frames of the silver halide photosensitive material able to be exposed and the number of exposed image frames obtained in accordance with the number of operations for reading exposure completion information. For example, the number of the operations for reading exposure completion information is counted so that the number of the exposed image frames is obtained. Then, the number of exposed image frames is subtracted from the number of all of frames of the silver halide photosensitive material able to be exposed so that the number of frames in the non-exposed region able to be exposed is obtained. Moreover, the means for recording information indicating the number of frames is able to record, on the non-exposed region, information indicating the obtained number of frames able to be exposed.

According to a fifth aspect of the present invention, there is provided an image exposing apparatus for sequentially exposing images to an elongated silver halide photosensitive material wound in a predetermined case such that exposure is started at an end of the silver halide photosensitive material, the image exposing apparatus comprising: exposure completion information recording means for recording exposure completion information indicating completion of exposure to positions corresponding to exposed image frames on an elongated silver halide photosensitive material when images are exposed.

An image exposing apparatus according to a sixth aspect of the present invention has a structure according to the fifth aspect and further comprising: means for reading information indicating the number of frames such that the means reads information recorded on the silver halide photosensitive material and indicating the number of frames able to be exposed; and notifying means for notifying the number of frames able to be exposed read by the means for reading information indicating the number of frames.

The image exposing apparatus according to the fifth aspect of the present invention has a structure such that when images each having a predetermined size are sequentially exposed starting at an end of an elongated silver halide photosensitive material wound up in a predetermined case, the means for recording information indicating completion of exposure is able to record exposure completion information indicating completion of exposure at positions corresponding to the exposed image frames on the silver halide photosensitive material.

An image exposing apparatus according to a sixth aspect of the present invention has a structure according to the fifth aspect and further comprising means for reading information indicating the number of frames and notifying means. Thus, information indicating the number of frames able to be exposed and recorded on the silver halide photosensitive material can be read by the means for reading information indicating the number of frames. Moreover, the number of the frames able to be exposed can be notified.

As a result, an operator for exposing images by using the non-exposed region is able to recognize the number of frames able to be exposed.

As described above, the present invention enables exposed image frames of the silver halide photosensitive material to adequately be determined and thus only the exposed image frames can be developed. Since the non-exposed region is rewound into the case, it can be used when next image exposure is performed. Moreover, only the exposed image frames can be developed even in a state where all of the frames of the silver halide photosensitive material have not been exposed, that is, a portion of the frames has been exposed. Thus, the necessity to wait for completion of exposure of all of the frames of the silver halide photosensitive material can be eliminated.

Moreover, the second aspect of the present invention has a special effect enabling an operator for exposing images by using the non-exposed region to recognize the number of frames able to be exposed.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

This invention will now be described with reference to the accompanying drawings wherein.

DESCRIPTION OF THE PREFERRED EMBODIMENTS

First Embodiment

Figure 1:
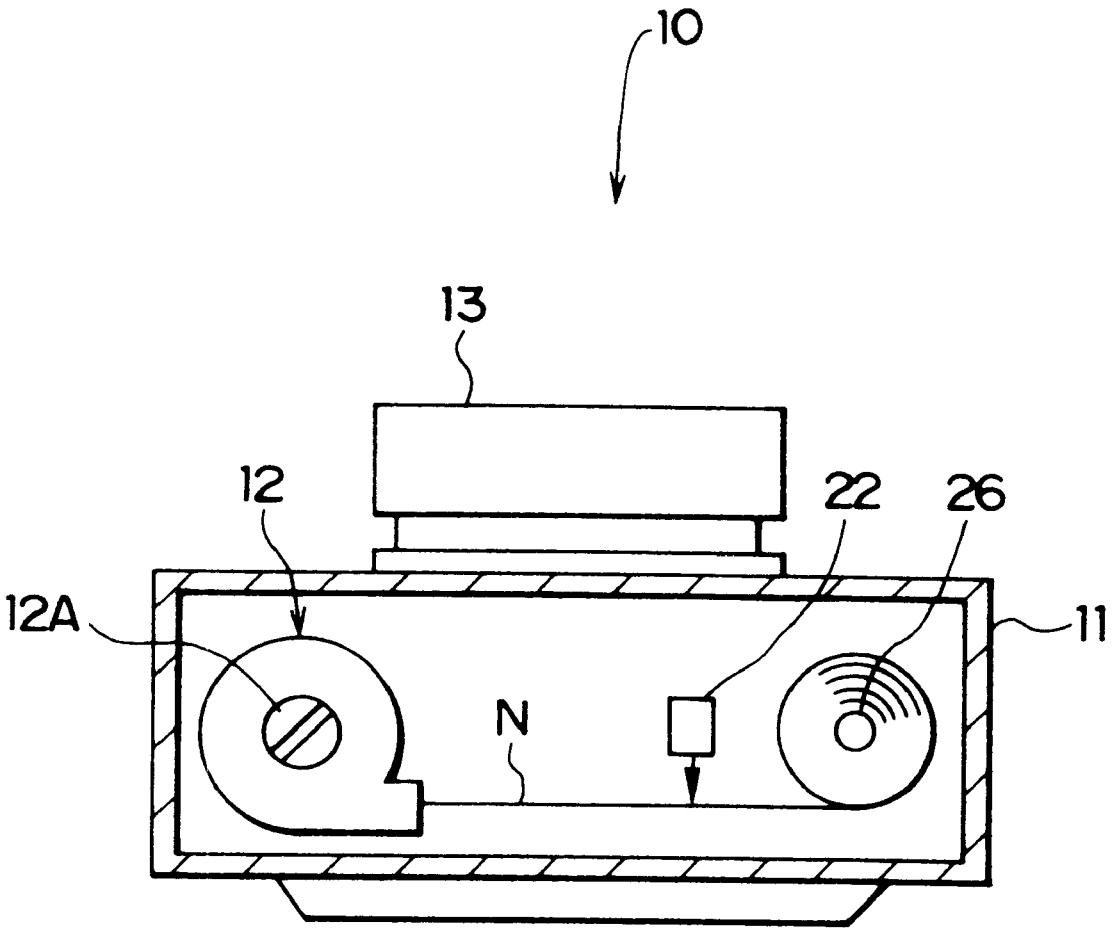
FIG. 1 is a diagram showing a state in which a negative film has been loaded into a camera according to a first embodiment of the present invention.

Referring to the drawings, a first embodiment of the present invention will now be described. The first embodiment has a structure such that exposure completion information indicating completion of exposure is, when a photograph is taken, recorded on a magnetic recording portion corresponding to each exposed frame of a negative film N which is the silver halide photosensitive material according to the present invention; and the exposed frames are determined in accordance with exposure completion information when the film is developed so that only the exposed frames are developed.

In this embodiment, the negative film N comprises a base and a heat developing photosensitive material formed on the base and including three or more types of photosensitive layers each containing at least photosensitive silver halide, a binder and a coloring material having a function for discharging or diffusing diffusible pigment in the form corresponding to the photographed image, the three or more types of the photosensitive layers having individual photosensitive wavelength regions and hues of the coloring material realized after having been developed. A processing member K having, on a base thereof, a layer containing at least dye mordant is used in order to form an image on the heat developing photosensitive material containing the coloring material when the processing member K and the heat developing photosensitive material containing the coloring material are overlapped so as to be heated.

Figure 2:
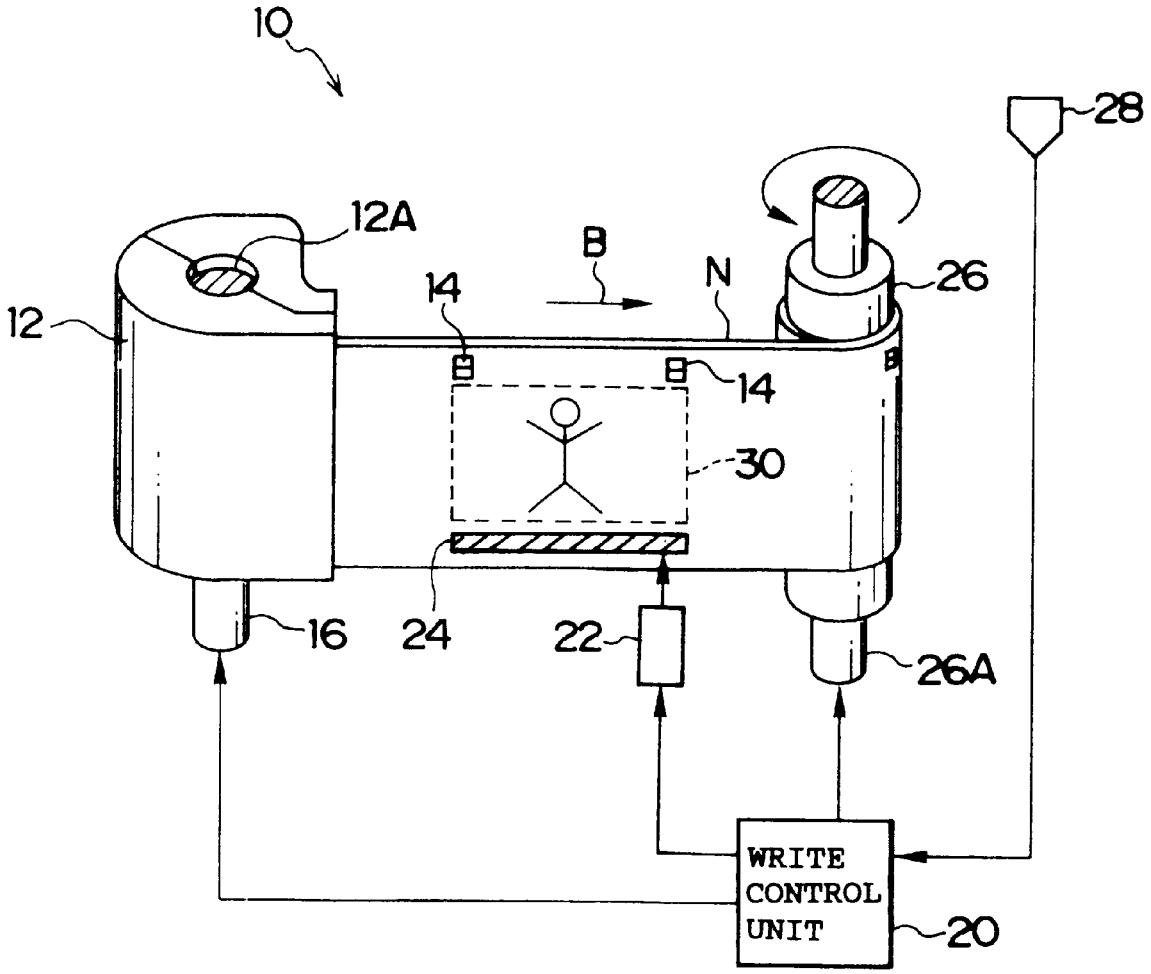
FIG. 2 is a block diagram showing components according to the first embodiment and relating to an operation for recording exposure completion information on the negative film.

Referring to FIGS. 1 and 2, the structure of a camera 10 using the negative film N to take a photograph, that is, to expose an image to the negative film N will now be described. FIG. 1 is a perspective view showing the camera 10 when viewed from an upper position. As shown in FIG. 1, a magazine 12 is loaded into a casing 11. The negative film N is drawn out from the magazine 12 so that the negative film N is carried along the surface (the lower surface when viewed in FIG. 1) of the casing 11 opposite to a lens 13. Then, the negative film N is wound up by a winding reel 26 disposed at an end (at a right-hand end shown in FIG. 1) of the casing 11 opposite to the magazine 12. Moreover, a recording portion 22 for recording exposure completion information as described later is disposed adjacent to the passage through which the negative film N is carried.

As shown in FIG. 2, the camera 10 has a control unit 20 comprising a microcomputer and structured to control a process for recording exposure completion information on the negative film N. The control unit 20 controls the operations of the recording portion 22, a drive shaft 16 for rotating a spool 12A of the magazine 12 and a drive shaft 26A for rotating the winding reel 26 so as to cause carrying of the negative film N and recording of the exposure completion information to be performed in synchronization with each other.

Moreover, the control unit 20 is structured to be capable of recognizing operation of a shutter 28 for issuing an instruction to photograph an object.

The negative film N according to this embodiment has perforations 14 each of which is formed adjacent to each end of each of frames 30 when viewed in a carrying direction indicated by an arrow B shown in FIG. 2. Moreover, a magnetic recording portion 24 is formed in the lengthwise direction of the negative film N at a position opposite to the perforations 14 when viewed in the widthwise direction of the negative film N. The exposure completion information is recorded in the magnetic recording portion 24 of the corresponding exposed frame.

Figure 4:
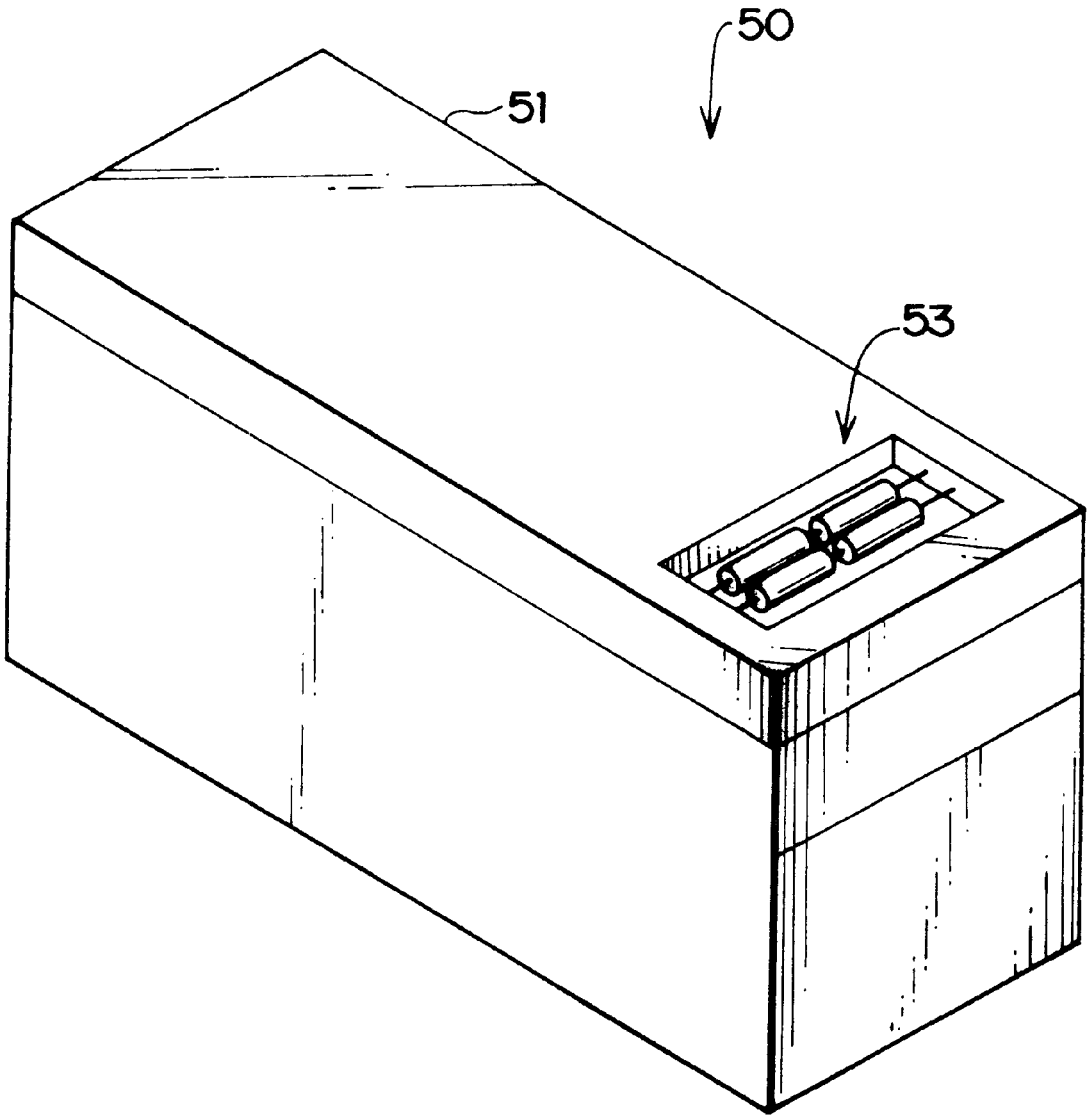
FIG. 4 is a perspective view showing the shape of a developing apparatus according to the first and second embodiments.
Figure 6:
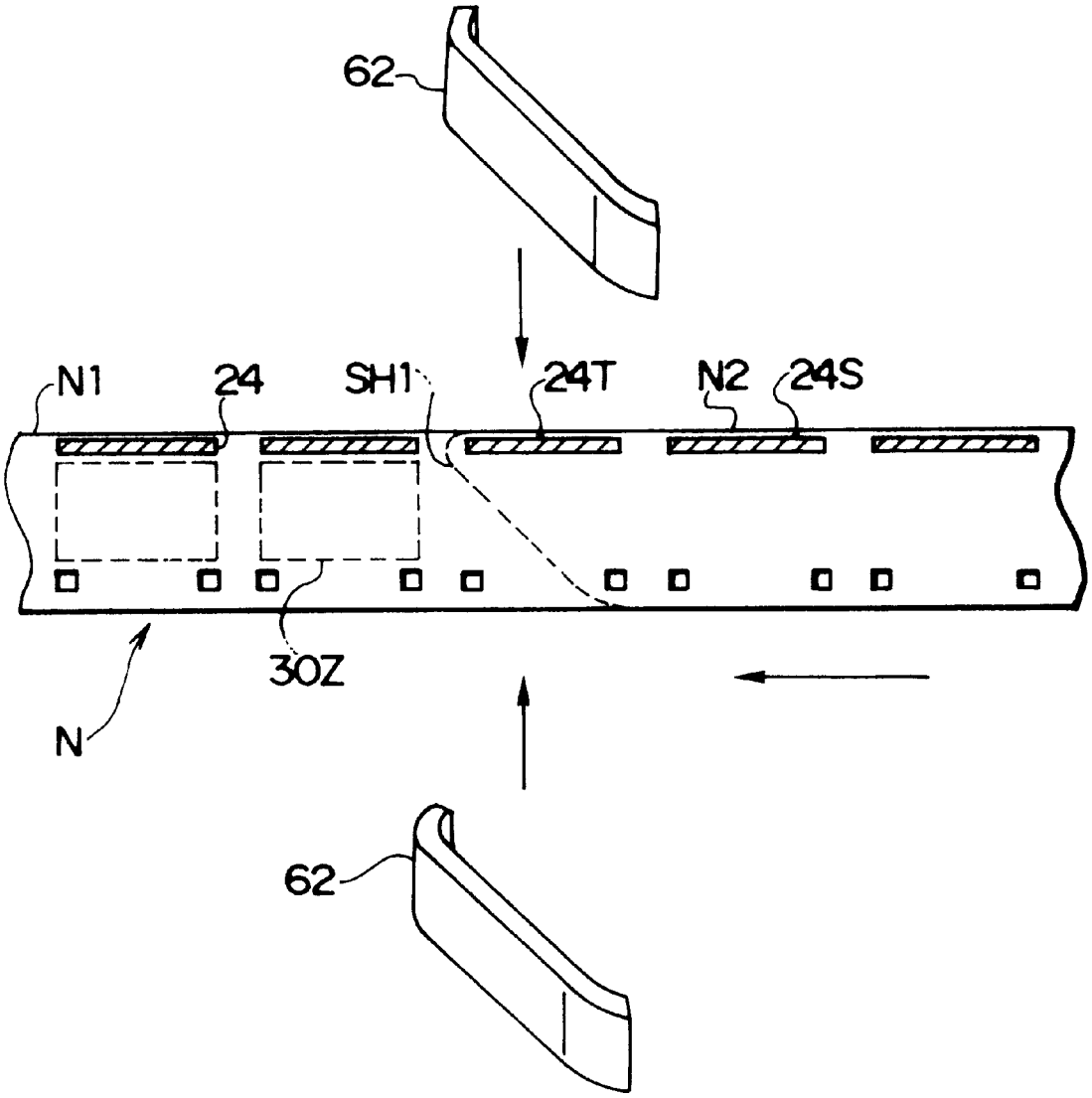
FIG. 6 is a diagram showing the shape of a cutter and a cut shape of the negative film.

Referring to FIGS. 4 and 6, the structure of a developing unit 50 for developing a negative film N photographed by the camera 10 will now be described. As shown in FIG. 4, the developing unit 50 is covered with a casing 51 in the form of a substantially rectangular parallelepiped. The developing unit 50 has a discharge portion 53 at an upper end thereof, the discharge portion 53 being structured to discharge the developed negative film N.

Figure 5:
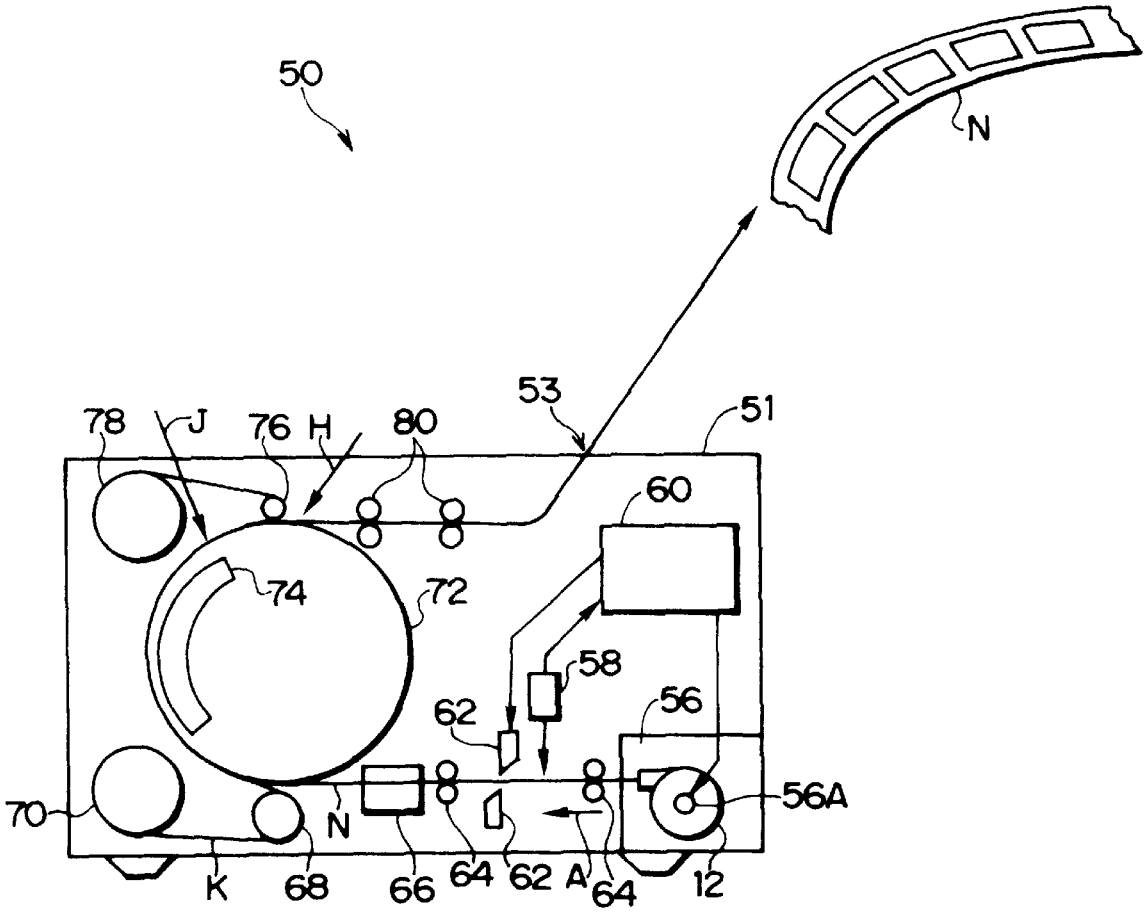
FIG. 5 is a schematic view showing the structure of the developing apparatus according to the first embodiment.

As shown in FIG. 5, the developing unit 50 has a magazine receiving portion 56 for receiving the magazine 12 accommodating the photographed negative film N. Thus, the negative film N is drawn out from the magazine 12 loaded into the magazine receiving portion 56, and then carried in a direction indicated by an arrow A by a carrying roller 64. A reading portion 58 is disposed downstream in the carrying direction, the reading portion 58 being structured to magnetically read exposure completion information and the like recorded on the negative film N. Moreover, a cutter 62 for cutting the negative film N is disposed further downstream of the reading portion 58. Exposure completion information and the like read by the reading portion 58 is supplied to a development control unit 60 for controlling processes which are performed in the developing unit 50. The development control unit 60 causes the cutter 62 to cut the negative film N at a predetermined timing in a manner to be described later. Then, the development control unit 60 rotates a drive shaft 56A to rewind one of the cut negative films N to the magazine 12. Note that the cutter 62, as shown in FIG. 6, cuts the negative film N in such a manner that the leading end of the cut negative film N draws an outline which is diagonal with respect to the lengthwise direction as indicated by a dashed line SH1.

A coating unit 66 having a carrying roller 64 for coating the negative film N with water which is an image forming solvent is disposed more downstream of the cutter 62.

Moreover, the developing unit 50 includes a supply reel 70 around which a processing member K is wound, the processing member K having a base on which a layer containing a dye mordant for developing the negative film N is formed. The processing member K is carried from the supply reel 70 to a carrying roller 68 so as to be wrapped about the outer surface of the carrying roller 68, and then wrapped about the outer surface (the left-hand outer surface when viewed in FIG. 5) of the drum 72. Then, the processing member K is wrapped about a carrying roller 76 disposed adjacent to the upper end of the drum 72, and then wound around the winding reel 78 to form a coil-like shape.

The negative film N is introduced between the lower surface of the drum 72 and the upper surface of the carrying roller 68, and then carried along the outer surface of the drum 72 while being held between the processing member K wrapped about and carried along the outer surface of the drum 72 and the outer surface of the drum 72. As a result, the negative film N and the processing member K can be carried in such a manner that the negative film N and the processing member K are overlapped. Referring to FIG. 5, a heating portion 74 is disposed adjacent to the left-hand outer surface of the drum 72, the heating portion 74 being structured to heat the overlapped negative film N and the processing member K.

When the overlapped negative film N and the processing member K have arrived at the top end of the drum 72, the processing member K is wrapped about the carrying roller 76 so that the processing member K is separated from the negative film N. Since the carrying roller 76 has a diameter considerably smaller than that of the drum 72, the curvature radius of the carrying passage for the processing member K is reduced at the top end of the drum 72 when the processing member K has been wrapped about the carrying roller 76. Thus, the processing member K can easily be separated from the negative film N. The separated negative film N is carried by a plurality of carrying rollers 80, and then discharged through the discharge portion 53.

Moreover, the development control unit 60 controls, as well as the operations of the cutter 62 and the rewinding drive shaft 56A, the operations for carrying the negative film N and the processing member K, the water spraying operation which is performed by the coating unit 66 and the heating operation which is performed by the heating portion 74.

The operation of the first embodiment will now be described. Initially, the process for recording exposure completion information on exposed frames when the camera 10 shown in FIGS. 1 and 2 photographs an object will now be described.

After a user has loaded the magazine 12 into a predetermined position in the camera 10, the user suspends a button for locking the photographing operation to enable the camera 10 to photograph an object. Thus, the control unit 20 starts executing a control routine shown in FIG. 3.

Figure 3:
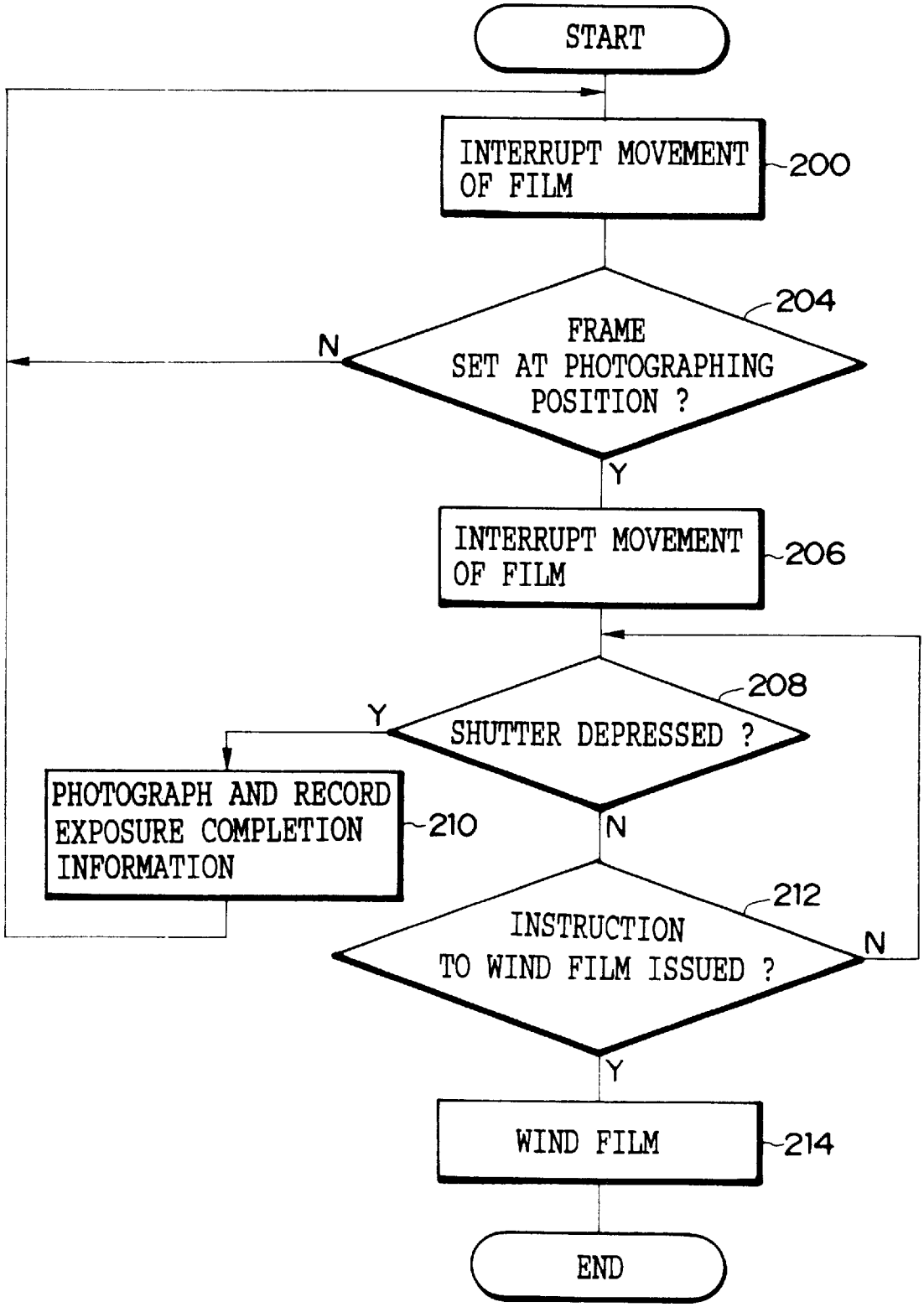
FIG. 3 is a flow chart showing a control routine which is performed by a control unit of the camera according to the first embodiment.

In step 200 shown in FIG. 3 the negative film N is carried, and in step 204 whether or not the frame of the negative film N has been placed at a predetermined photographing position is determined. When the frame of the negative film N has positioned to the predetermined photographing position, the operation proceeds to step 206 so that carrying of the negative film N is interrupted. In step 208 whether or not the shutter 28 has been depressed is determined.

If the shutter 28 is not depressed, the operation proceeds to step 212 so that whether or not winding has been instructed with a winding instruction button (not shown) is determined. Then, the determination in each of steps 208 and 212 is repeated. When the shutter 28 has been depressed, the operation proceeds to step 210.

In step 210 a usual photographing operation is performed and the recording portion 22 records exposure completion information on the magnetic recording portion 24. As a result of the operations in step 210, photographing (exposure of an image) of one frame positioned to the photographing position and recording of exposure completion information indicating that the frame has been exposed are completed. Then, the operation returns to step 200 in order to position a next frame to the photographing position.

The foregoing steps 200 to 212 are repeated so that each of the frames is photographed and exposure completion information is recorded on each of the magnetic recording portions 24 corresponding to the exposed frames.

If an instruction to wind the negative film N is issued, an affirmative determination is performed in step 212, and the operation proceeds to step 214 so that the drive shaft 16 is rotated in a direction opposite to the direction in which the negative film N is carried. As a result, the spool 12A is rotated in the winding direction so that the negative film N is wound up.

As a result of the above-mentioned process for recording exposure completion information, exposure completion information is recorded on only the magnetic recording portions 24 that correspond to the exposed frames of the negative film N.

A process for thermally developing the negative film N in the developing unit 50 shown in FIGS. 4 and 5 will now be described. When an operator loads the magazine 12 into the magazine receiving portion 56 of the developing unit 50, bonds a leader member having a predetermined length to the leading end of the negative film N accommodated in the magazine 12 and then operates a start button (not shown), a control routine shown in FIG. 7 is started by the development control unit 60.

Figure 7:
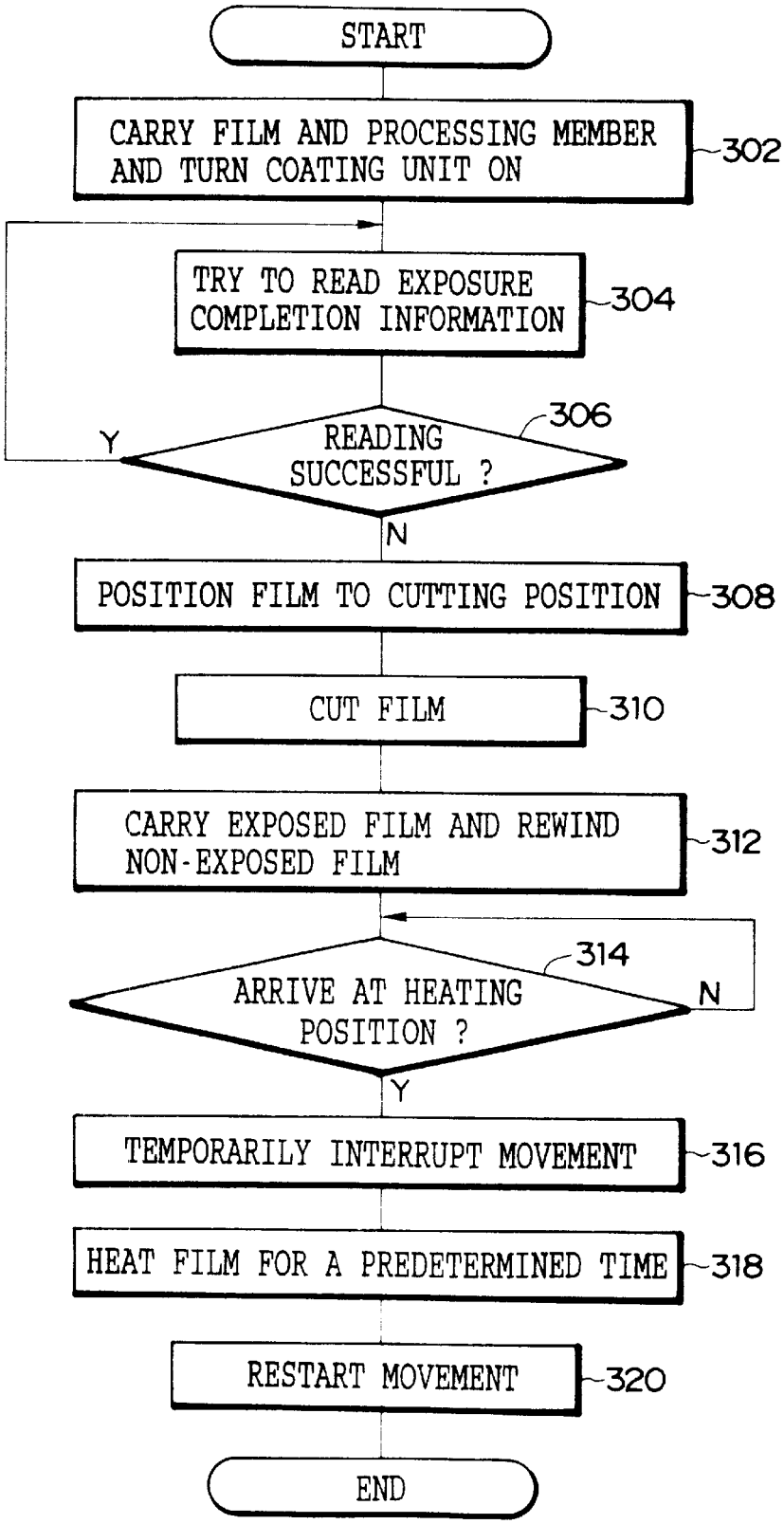
FIG. 7 is a flow chart showing a control routine which is performed by a development control unit in the developing apparatus according to the first embodiment.

In step 302 shown in FIG. 7 the negative film N and the processing member K are carried and the coating unit 66 is turned on. In step 304 the reading portion 58 tries to read exposure completion information from the magnetic recording portion 24 corresponding to the first frame of the negative film N which is being carried. If exposure completion information can be read (if an affirmative determination is performed in step 306), the reading portion 58 tries to read exposure completion information from the magnetic recording portion 24 corresponding to the next frame. As described above, reading of exposure completion information is sequentially tried from each frame of the negative film N.

If exposure completion information cannot be read, a negative determination is performed in step 306, and then the operation proceeds to step 308 so that a boundary between a final frame 30Z of the exposed frames of the negative film N and a non-exposed region more adjacent to the magazine 12 than the final frame 30Z is positioned to the cutting position for the cutter 62, as shown in FIG. 6.

In step 310 the positioned negative film N is cut by the cutter 62. At this time, the leading end of the non-exposed region of the negative film N is cut in such a manner that, for example, the leading end draws an outline which is diagonal with respect to the lengthwise direction as indicated by a dashed line SH1 shown in FIG. 6. Thus, the shape of the leading end of the negative film N is formed at the foregoing leading end.

In step 312 the portion of the negative film N including the exposed frames (hereinafter called as an "exposed negative film N1") is carried in a direction indicated by an arrow A shown in FIG. 5. Moreover, the portion of the negative film N including the non-exposed region (hereinafter called as a "non-exposed negative film N2") is carried in a direction opposite to the direction indicated by the arrow A shown in FIG. 5 by a drive shaft 56A so that the foregoing portion is rewound in the magazine 12. As described above, the non-exposed negative film N2 can be rewound in the magazine 12 so as to be used in a next photographing operation. Since the leading end of the non-exposed negative film N2 has the shape indicated by the dashed line SH1 shown in FIG. 6, the leading end can easily be fed in the camera when a next photographing operation is performed. Thus, an advantage can be realized in that setting up for the photographing operation can smoothly be performed.

In step 314 shown in FIG. 7 whether or not the exposed frame at the leading end of the exposed negative film N1 has arrived at a heating position (a position indicated by an arrow J shown in FIG. 5) to be described later is monitored. The foregoing operation for carrying of the exposed negative film N1 and the monitoring operation are continued until the leading exposed frame arrives at the heating position.

As a result, the exposed negative film N1 is continuously carried in the direction indicated by the arrow A shown in FIG. 5 so that the exposed negative film N1 passes through the coating unit 66. At this time, the surface of the exposed negative film N1 is coated with water. The exposed negative film N1 coated with water is carried in the direction indicated by the arrow A shown in FIG. 5 so as to be introduced between the lower end of the drum 72 and the upper end of the carrying roller 68. The exposed negative film N1 is held between the processing member K carried from the supply reel 70 and wrapped about the carrying roller 68 and the outer surface of the drum 72 and carried around the outer surface of the drum 72 clockwise when viewed in FIG. 5. Also the processing member K is carried at the same carrying speed as the speed at which the exposed negative film N1 is carried. Since the exposed negative film N1 has been coated with water, the exposed negative film N1 and the processing member K are carried around the outer surface of the drum 72 in a state where no gap is formed between the exposed negative film N1 and the processing member K.

When the leading end of the exposed negative film N1 has arrived at the final portion (indicated by the arrow J) of the heating region (a region heated by the heating portion 74) on the outer surface of the drum 72, the exposed negative film N1 is determined that it has arrive at the heating position. Thus, an affirmative determination is performed in step 314.

In step 316 carrying of the exposed negative film N1 and the processing member K is temporarily interrupted. In step 318 the heating portion 74 heats the exposed negative film N1 and the processing member K in a contact state for a predetermined time.

Thus, diffusible pigment is discharged or diffused from the coloring material contained in the exposed negative film N1 so that the diffusible pigment is partially or completely removed from the exposed negative film N1. As a result, a color image in at least three colors is formed on the exposed negative film N1. Since water is allowed to adhere to the exposed negative film N1, the exposed negative film N1 can uniformly be developed with heat.

After the exposed negative film N1 has been heated for a predetermined time, the operation proceeds to step 320 so that carrying of the exposed negative film N1 and the processing member K is restarted. When the exposed negative film N1 and the processing member K have been carried to the top end (a portion indicated by an arrow H) of the drum 72, the processing member K is wrapped about the carrying roller 76. On the other hand, the exposed negative film N1 is carried to the discharge portion 53 by the carrying roller 80. As a result, the exposed negative film N1 and the processing member K are separated from each other. Then, the processing member K is wound up by the winding reel 78, while the exposed negative film N1 is discharged to the outside from the discharge portion 53.

The foregoing process is structured such that carrying of the exposed negative film N1 and the processing member K is temporarily interrupted and the overall body of the exposed negative film N1 is, at a time, developed with heat by the heating portion 74. As an alternative to this, another development process may be employed. That is, simultaneously with starting carrying the exposed negative film N1 and the processing member K in step 302, the heating portion 74 starts heating the exposed negative film N1 and the processing member K to heat the exposed negative film N1 coated with water by the coating unit 66 during a period in which the exposed negative film N1 is, at the same speed, carried by the processing member K and the drum 72. If the exposed negative film N1 is held as described above and carried at the same speed, the frames of the exposed negative film N1 can be heated for the same time. Thus, the exposed negative film N1 can be developed satisfactorily without irregular results of the development. If the above-mentioned heat development process is employed, the necessity for the heating portion 74 to have a large size capable of heating the overall body of the exposed negative film N1 can be eliminated. Moreover, carrying of the exposed negative film N1 and the processing member K is not required to be temporarily interrupted and restarted (the processes in steps 314 to 320 shown in FIG. 7 can be omitted). As a result, the exposed negative film N1 can be developed with heat during carrying of the same.

As can be understood from the foregoing description, the first embodiment enables only the exposed frames of the negative film N to be developed with heat. As a result, images are visualized in all of the exposed frames. The non-exposed region of the negative film N is not developed with heat and the portion is returned so as to be rewound in the magazine 12. That is, the waste process for developing the non-exposed region can be omitted and the non-exposed region can be exposed later.

Figure 13:
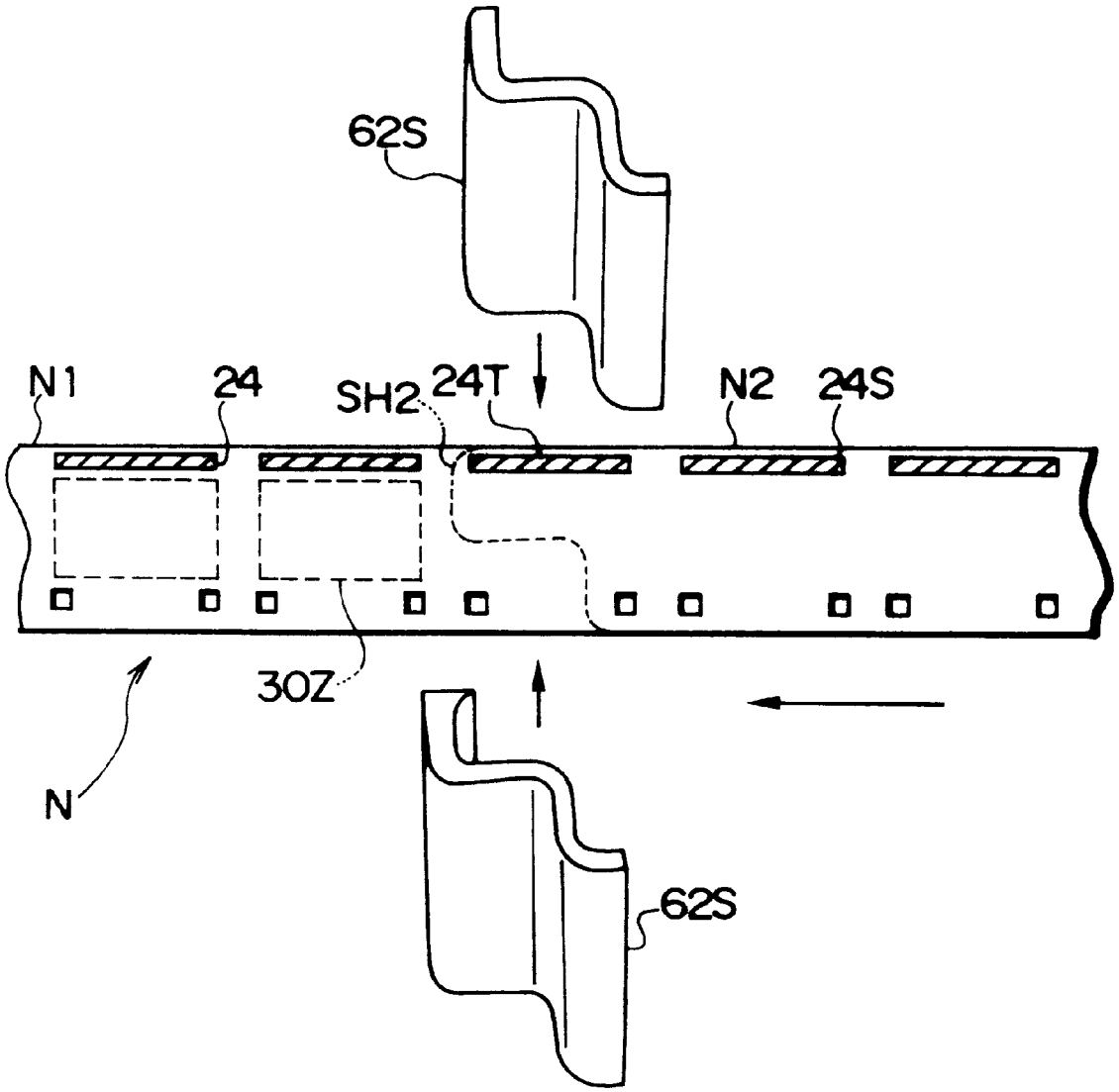
FIG. 13 is a diagram showing a cutter having another shape and a shape of a negative film cut by the cutter.

The cutter 62 according to the first embodiment is not limited to the shape shown in FIG. 6. For example, a cutter 62S having another shape may be employed which has, as shown in FIG. 13, a shape such that the leading end of the non-exposed region (the non-exposed negative film N2) is narrowed in the widthwise direction, that is, a shape like the tongue.

Second Embodiment

A second embodiment of the present invention will now be described. The second embodiment has a structure such that the number of frames in the non-exposed region able to be exposed is obtained in accordance with exposure completion information described in the first embodiment; information indicating the number of the frames able to be exposed is recorded on the non-exposed negative film N2; and information indicating the number of the frames able to be exposed is read when a next photographing operation is performed so as to be notified to the user.

Figure 8:
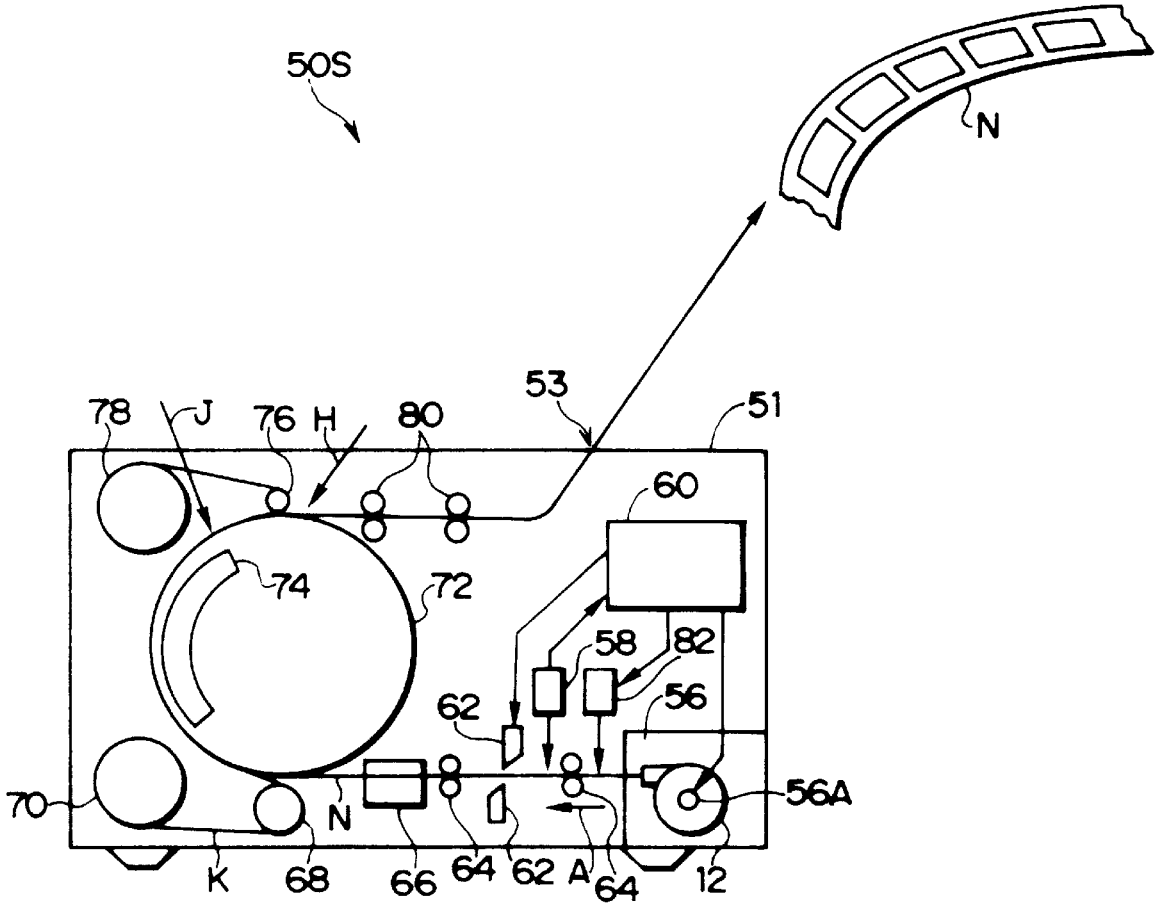
FIG. 8 is a schematic view showing the structure of a developing apparatus according to the second embodiment of the present invention.

Referring to FIG. 8, a developing unit 50S according to the second embodiment will now be described. The same elements as those of the developing unit 50 according to the first embodiment shown in FIG. 5 are given the same reference numerals and the same elements are omitted from description.

The developing unit 50S according to the second embodiment shown in FIG. 8 has a development control unit 60 which counts the number of the operations performed by the reading portion 58 to read exposure completion information to obtain the number of exposed frames and subtract the number of the exposed frames from all of the frames of the negative film N able to be exposed so as to obtained the number of frames in the non-exposed region able to be exposed. The developing unit 50S has an information writing portion 82 to record information of the number of frames, which are able to be exposed, on a magnetic recording portion 24S (for example, a second magnetic recording portion from the leading end of the non-exposed negative film N2) of the non-exposed negative film N2 shown in FIG. 6 when the non-exposed region (the non-exposed negative film N2) of the cut negative film N is rewound in the magazine 12.

Figure 10:
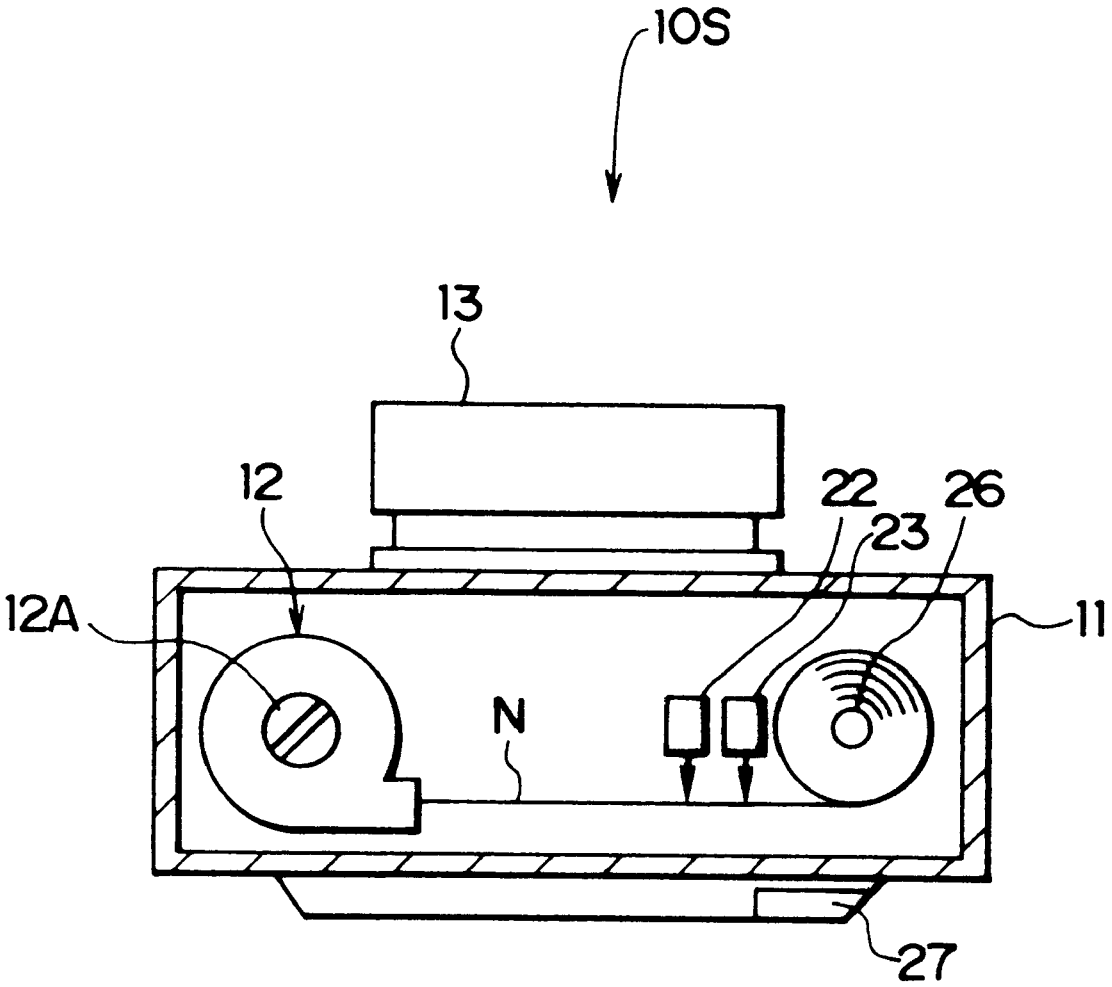
FIG. 10 is a diagram showing a state in which a negative film has been loaded into a camera according to the second embodiment.
Figure 11:
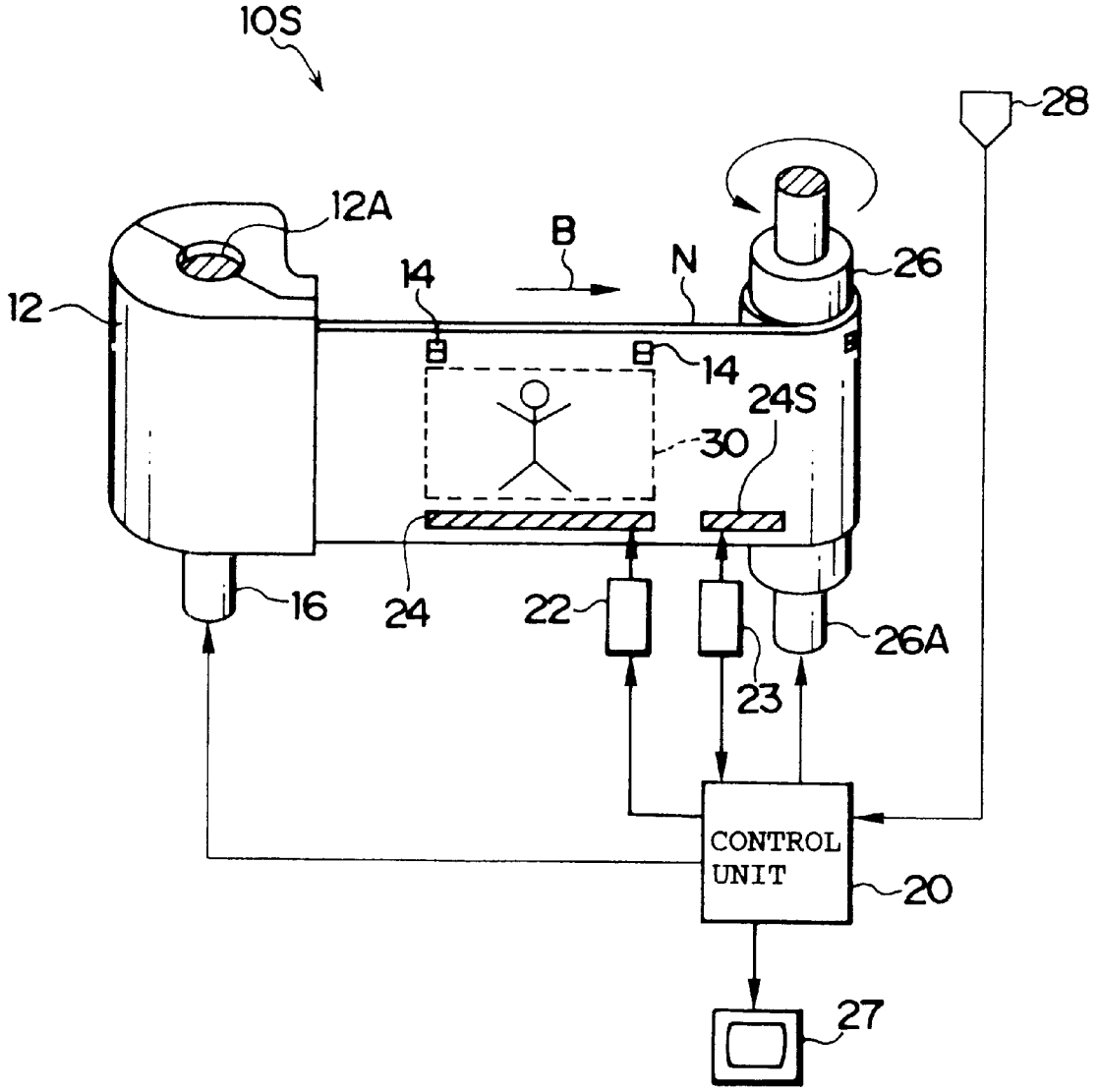
FIG. 11 is a block diagram showing components according to the second embodiment and relating the operations for recording exposure completion information on the negative film and reading the number of frames in the non-exposed region able to be exposed.

Referring to FIGS. 10 and 11, the structure of a camera 10S according to the second embodiment will now be described. As shown in FIGS. 10 and 11, the camera 10S has an information reading portion 23 for reading information (for example, information of the number of frames able to be exposed) recorded on the magnetic recording portion 24S of the non-exposed negative film N2 to notify it to the control unit 20. Moreover, the camera 10S has, on the outer surface of the casing 11, a display portion 27 for displaying information of the number of frames able to be exposed and other information items.

Figure 9:
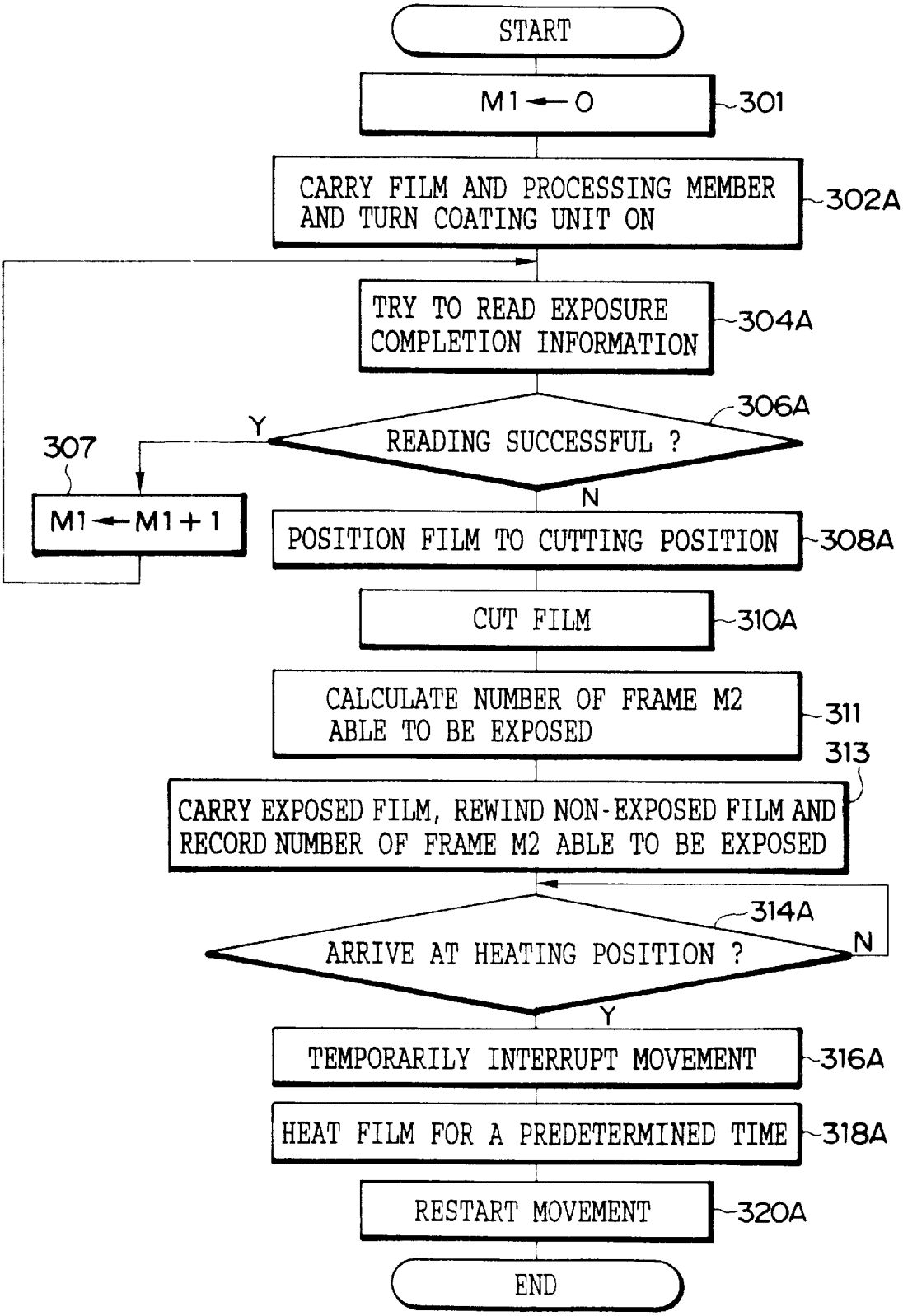
FIG. 9 is a flow chart showing a control routine which is performed by a development control unit in the developing apparatus according to the second embodiment.

The operation of the second embodiment will now be described. Referring to FIG. 9, a process in which the negative film N is developed with heat by the developing unit 50S will now be described. Note that the same steps as those in the heat development process according to the first embodiment shown in FIG. 7 are given symbol "A" to the trailing end of the step number and the same steps are omitted from description.

In first step 301 of the heat development process shown in FIG. 9, a counter M1 for counting the number of exposed frames is reset to zero. In step 302A the negative film N and the processing member K are carried and the coating unit 66 is turned on. In step 304A reading of exposure completion information of the first frame is tried. If exposure completion information can be read (if an affirmative determination is performed in step 306A), a determination can be performed that one exposed frame has been detected. Therefore, the operation proceeds to step 307 so that the count of the counter M1 is increased.

Then, the operation returns to step 304A so that reading of exposure completion information of a next frame is tried. If exposure completion information can be read, the operation proceeds to step 307 so that the count of the counter M1 is again increased. As described above, exposure completion information of the frames of the negative film N are tried to be read. Whenever exposure completion information can be read, the count of the counter M1 is increased. When exposure completion information cannot be read, a determination can be performed that all of the exposed frames have been detected. Therefore, the operation proceeds to step 308A. At this time, the number of exposed frames has been set to the counter M1.

In step 310A the boundary between the final exposed frame and the non-exposed region of the negative film N is cut by the cutter 62. In step 311 the number of exposed frames indicated by the counter M1 is subtracted from the number of all of the frames of the negative film N able to be exposed to obtain the number M2 of frames in the non-exposed region able to be exposed. Information of the number of all of the frames of the negative film N able to be exposed may be, by a barcode reader, obtained from a barcode previously recorded on the side surface of the magazine 12 and indicating information of the number of all of the frames able to be exposed when the magazine 12 has been loaded into the magazine receiving portion 56. As an alternative to this, information may be obtained from the leading magnetic recording portion of the negative film N on which information indicating the number of all of the frames able to be exposed is recorded such that the reading portion 58 reads information above.

In step 313 the exposed frame portion (the exposed negative film N1) of the cut negative film N is carried in a direction indicated by an arrow A in FIG. 8. On the other hand, the non-exposed region (the non-exposed negative film N2) is carried in a direction opposite to the direction indicated by the arrow A shown in FIG. 8 so as to be rewound in the magazine 12. During the rewinding operation, information indicating the number M2 of the frames in the non-exposed region able to be exposed is recorded on the magnetic recording portion 24S of the non-exposed negative film N2 shown in FIG. 6 by the information writing portion 82. In steps 314A to 320A the process for developing only the exposed frames of the exposed negative film N1 with heat is performed similarly to the first embodiment.

As a result of the process shown in FIG. 9, the number M2 of the frames in the non-exposed region able to be exposed is calculated and information indicating the foregoing number is recorded on the magnetic recording portion 24S of the non-exposed negative film N2. Then, the non-exposed negative film N2 is rewound into the magazine 12.

A process for photographing an object by using the camera 10S having the non-exposed negative film N2 rewound into the magazine 12 will now be described with reference to FIG. 12.

Figure 12:
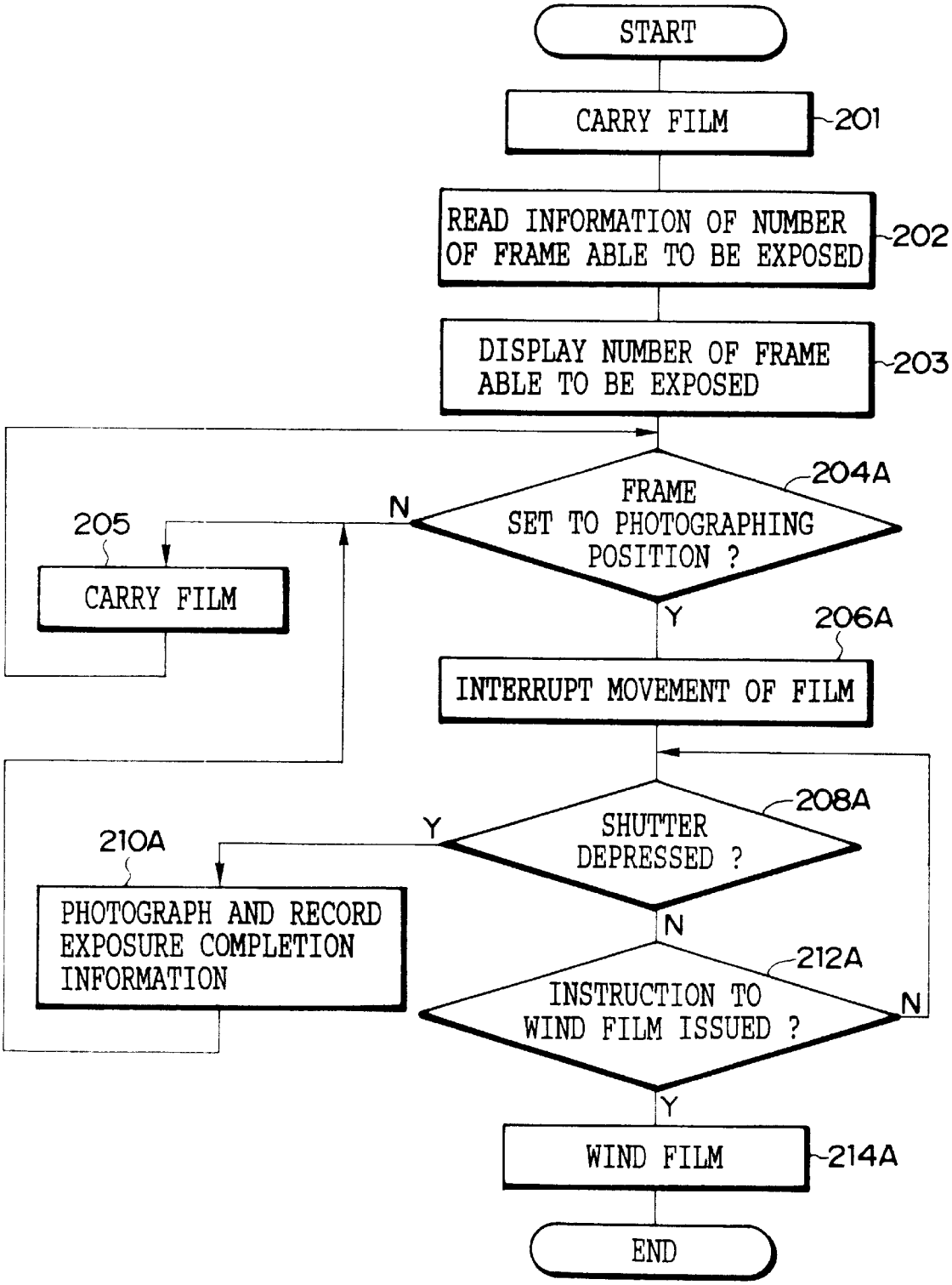
FIG. 12 is a flow chart showing a control routine which is performed by a control unit in the camera according to the second embodiment.

When a user has loaded the magazine 12 into a predetermined position in the camera 10S and suspended a button (not shown) for locking a photographing operation to enable the camera 10S to photograph an object, the control unit 20 starts executing a control routine shown in FIG. 12.

In step 201 shown in FIG. 12 the non-exposed negative film N2 is carried. In step 202 the information reading portion 23 reads information indicating the number M2 of the frames able to be exposed from the magnetic recording portion 24S. In step 203 the read number M2 of the frames able to be exposed is displayed on the display portion 27. As a result, the user is able to recognize the number M2 of the frames in the non-exposed region able to be exposed in accordance with the display on the display portion 27.

The above-mentioned second embodiment is able to detect the number M1 of exposed frames in accordance with exposure completion information recorded on the negative film N when an object has been photographed to calculate the number M2 of the frames in the non-exposed region able to be exposed. By previously recording information indicating the number M2 of the frames able to be exposed on a non-exposed region (the non-exposed negative film N2) of the negative film N, the non-exposed negative film N2 can be used in a photographing operation such that the number M2 of the frames able to be exposed is displayed on the display portion 27 to enable the user to recognize the number M2 of the frames able to be exposed.

Although the second embodiment has the structure such that the number M2 of frames able to be exposed is calculated by the developing unit 50S, it may be calculated by the camera 10S. That is, the developing unit 50S counts the number of the operations for reading the exposure completion information to detect the number M1 of exposed frames so as to record, on the non-exposed negative film N2, information indicating the number M1 of the exposed frames and information indicating the number of all of the frames of the negative film N able to be exposed. When the non-exposed negative film N2 is used when objects are photographed, the camera 10S reads information indicating the number M1 of the exposed frames and information indicating the number of all of the frames able to be exposed to subtract the number M1 of the exposed frames from the number of all of the frames so as to calculate the number M2 of the frames in the non-exposed region able to be exposed.

Although the first and second embodiments have the structure such that exposure completion information and information indicating the number M2 of the frames able to be exposed are magnetically recorded on the magnetic recording portion 24 previously provided for the negative film N, information may be recorded by exposing predetermined marks or barcodes indicating completion of the exposure with a considerably quantity of exposure. As an alternative to this, information may be recorded by forming predetermined cut portions or holes in the negative film N.

The negative film N serving as the silver halide photosensitive material according to the first and second embodiment may be a negative film having a base and at least three types of photosensitive layers formed on the base, each of at least three types of the photosensitive layers containing at least photosensitive silver halide, a binder and a pigment donating coupler and having individual photosensitive wavelength regions and hues of the pigments formed from the pigment donating coupler.

While the embodiments of the present invention, as herein disclosed, constitute a preferred form, it is to be understood that other forms might be adopted.

What is claimed is:

1. A development control method comprising the steps of:

recording exposure completion information indicating completion of exposure to positions corresponding to exposed image frames on an elongated silver halide photosensitive material wound up in a predetermined case when sequential exposure of images having a predetermined size is performed from an end of the elongated silver halide photosensitive material;

sequentially reading exposure completion information when the silver halide photosensitive material is drawn out from said case to develop the silver halide photosensitive material;

determining a final image frame of the silver halide photosensitive material on which exposure completion information has been recorded in accordance with a result of reading of exposure completion information and cutting and separating the determined final image frame and a non-exposed region more rearward than the final image frame from each other; and developing an exposed region including the exposed image frames and rewinding the non-exposed region in said case.

2. A development control method according to claim 1, wherein when the silver halide photosensitive material is drawn out from said case so as to be developed, the number of frames in the non-exposed region able to be exposed is calculated in accordance with the number of all of frames of the silver halide photosensitive material able to be exposed and the number of exposed image frames obtained in accordance with the number of operations for reading exposure completion information, information indicating the obtained number of frames able to be exposed is recorded on the non-exposed region, information indicating the number of frames able to be exposed is read when the non-exposed region rewound in said case is drawn out from said case to be exposed to images, and the number of frames able to be exposed is notified.

3. A development control method according to claim 1, wherein exposure completion information is magnetically recorded and read.

4. A development control method according to claim 2, wherein information indicating the number of frames able to be exposed is magnetically recorded and read.

5. A development control method according to claim 1, wherein cutting and separation of the final image frame on which exposure completion information has been recorded and the non-exposed region more rearward than the final image frame from each other are performed in such a manner that a cut portion draws an outline which is diagonal with respect to the lengthwise direction of the silver halide photosensitive material.

6. A development control method according to claim 1, wherein cutting and separation of the final image frame on which exposure completion information has been recorded and the non-exposed region more rearward than the final image frame from each other are performed in such a manner that the leading end of the non-exposed region is formed into a tongue-like shape which is narrowed in the widthwise direction.

7. A development control method according to claim 1, wherein the silver halide photosensitive material has a base and at least three types of photosensitive layers formed on the base, at least the three types of the photosensitive layers each containing at least a photosensitive silver halide, a binder and a coloring material having a function of discharging or diffusing a diffusible pigment in the form of the image and having individual photosensitive wavelength regions and hues of the coloring materials after the development has been completed.

8. A development control method according to claim 1, wherein the silver halide photosensitive material has a base and at least three types of photosensitive layers formed on the base, at least the three types of the photosensitive layers each containing at least a photosensitive silver halide, a binder and a pigment donating coupler and having individual photosensitive wavelength regions and hues of the pigments formed from the pigment donating coupler.

9. A developing apparatus for drawing out, from a predetermined case, an elongated silver halide photosensitive material, having exposed images to have a predetermined size and exposure completion information recorded at positions corresponding to the exposed frames and indicating completion of exposure, and wound up in said case, so as to develop the elongated silver halide photosensitive material, said developing apparatus comprising:

cutting means for cutting the silver halide photosensitive material;

exposure completion information reading means for sequentially reading exposure completion information from the drawn out silver halide photosensitive material;

cutting control means for determining a final image frame of the silver halide photosensitive material on which exposure completion information has been recorded in accordance with a result of reading of exposure completion information performed by said exposure completion information reading means and controlling said cutting means to cut and separate the determined final image frame and a non-exposed region more rearward than the final image frame from each other; and rewinding means for rewinding the cut and separated non-exposed region into said case.

10. A developing apparatus according to claim 9, further comprising:

calculating means for obtaining the number of frames in the non-exposed region able to be exposed in accordance with the number of all of frames of the silver halide photosensitive material able to be exposed and the number of exposed image frames obtained in accordance with the number of operations for reading exposure completion information; and means for recording information indicating the number of frames such that said means records, on the non-exposed region, information indicating the number of frames able to be exposed and which have been obtained by said calculating means.

11. A developing apparatus according to claim 9, further comprising means for recording information indicating the number of reading operations on the non-exposed region.

12. A developing apparatus according to claim 9, wherein said exposure completion information reading means magnetically reads exposure completion information.

13. A developing apparatus according to claim 10, wherein said means for recording information indicating the number of frames magnetically records information indicating the number of frames able to be exposed.

14. A developing apparatus according to claim 11, wherein said means for recording information indicating the number of reading operations magnetically records information indicating the reading operations.

15. A developing apparatus according to claim 9, wherein said cutting means cuts the silver halide photosensitive material in such a manner that the cut portion draws an outline which is diagonal with respect to the lengthwise direction of the silver halide photosensitive material.

16. A developing apparatus according to claim 9, wherein said cutting means cuts the silver halide photosensitive material in such a manner that the leading end of the non-exposed region is formed into a tongue-like shape narrowed in the widthwise direction.

17. An image exposing apparatus for sequentially exposing images to an elongated silver halide photosensitive material wound in a predetermined case such that exposure is performed in a predetermined size from an end of the silver halide photosensitive material, said image exposing apparatus comprising:

exposure completion information recording means for recording exposure completion information indicating completion of exposure to positions corresponding to exposed image frames on an elongated silver halide photosensitive material when images are exposed;

means for reading the number of operations for reading exposure completion information such that said means reads information recorded on the silver halide photosensitive material and indicating the number of operations for reading exposure completion information, calculating means for obtaining the number of frames in the non-exposed region able to be exposed in accordance with the number of all frames of the silver halide photosensitive material able to be exposed and the number of operations for reading exposure completion information; and notifying means for notifying the number of frames, able to be exposed, calculated by said calculating means.

18. An image exposing apparatus according to claim 17, further comprising:

means for reading information indicating the number of frames such that said means reads information recorded on the silver halide photosensitive material and indicating the number of frames able to be exposed; and notifying means for notifying the number of frames, able to be exposed, read by said means for reading information indicating the number of frames.

19. An image exposing apparatus according to claim 17, wherein carrying of the silver halide photosensitive material and recording which is performed by said exposure completion information recording means are performed in synchronization with each other.

* * * * *